United States Patent [19]

Nülle et al.

[11] Patent Number: 4,674,414

[45] Date of Patent: Jun. 23, 1987

[54] ONE-PIECE PALLET WITH PLURALITY OF LEGS

[75] Inventors: Henner Nülle, Bolivar, Ohio; Edmund Munk, Oberstenfeld; Helmuth Huber, Gronau, both of Fed. Rep. of Germany

[73] Assignee: Werzaklit-Werke J. F. Werz KG, Oberstenfeld, Fed. Rep. of Germany

[21] Appl. No.: 709,789

[22] Filed: Mar. 11, 1985

[30] Foreign Application Priority Data

Sep. 20, 1984 [EP] European Pat. Off. ..... 84111232.9

[51] Int. Cl.[4] ..... B65D 19/38

[52] U.S. Cl. ..... 108/53.3; 108/51.1; 108/901

[58] Field of Search ..... 108/53.3, 53.1, 51.1, 108/53.5, 901

[56] References Cited

U.S. PATENT DOCUMENTS

| | | | |
|---|---|---|---|
| 3,467,032 | 9/1909 | Rowlands et al. | 108/51.1 |
| 3,526,195 | 9/1970 | Maryonovich | 108/53.1 |
| 3,707,127 | 12/1972 | Palfey | 108/53.3 |
| 3,948,190 | 4/1976 | Cook, III et al. | 108/53.3 |
| 4,019,634 | 4/1977 | Bonnet | 108/53.3 X |
| 4,029,023 | 6/1977 | Rosewicz et al. | 108/53.3 X |
| 4,240,360 | 12/1980 | Sanders et al. | 108/53.3 |
| 4,318,351 | 3/1982 | Munk | 108/53.1 |
| 4,413,737 | 11/1983 | Wind | 108/53.3 X |

FOREIGN PATENT DOCUMENTS

| | | | |
|---|---|---|---|
| 2510547 | 9/1976 | Fed. Rep. of Germany | 108/53.3 |
| 2732373 | 2/1979 | Fed. Rep. of Germany | 108/51.1 |

*Primary Examiner*—Kenneth J. Dorner
*Assistant Examiner*—José V. Chen
*Attorney, Agent, or Firm*—Michael J. Striker

[57] ABSTRACT

A one-piece pallet formed of a non-risable mixture of fibers and a heat-hardenable binding agent is designed so that in loaded condition it can be supported in a transporting device or suspended on a stand and two edges of the pallet are supported on the supports wherein trough-shaped corner legs of the pallet are connected with one another by channel-like connecting webs which are curved inwardly and do not contact any other legs of the pallet.

13 Claims, 5 Drawing Figures

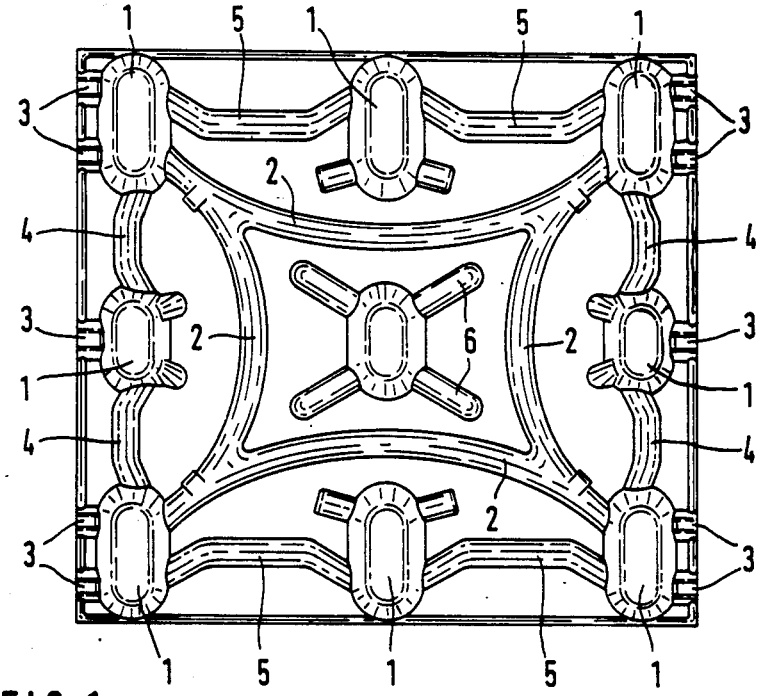
FIG. 1
FIG. 2
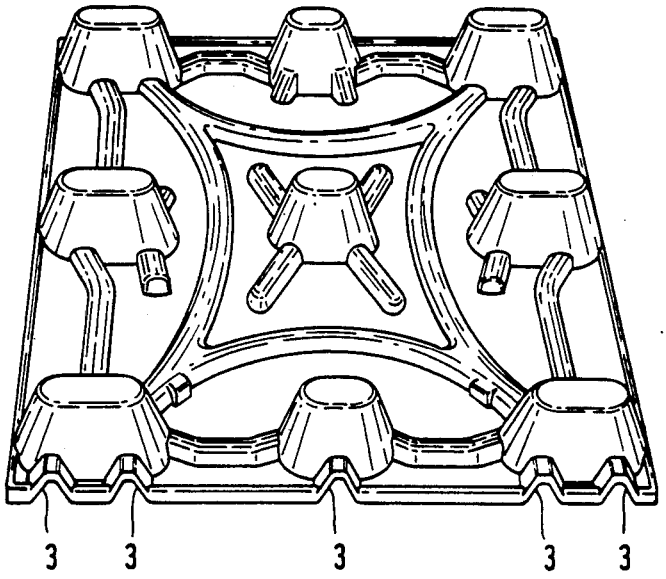

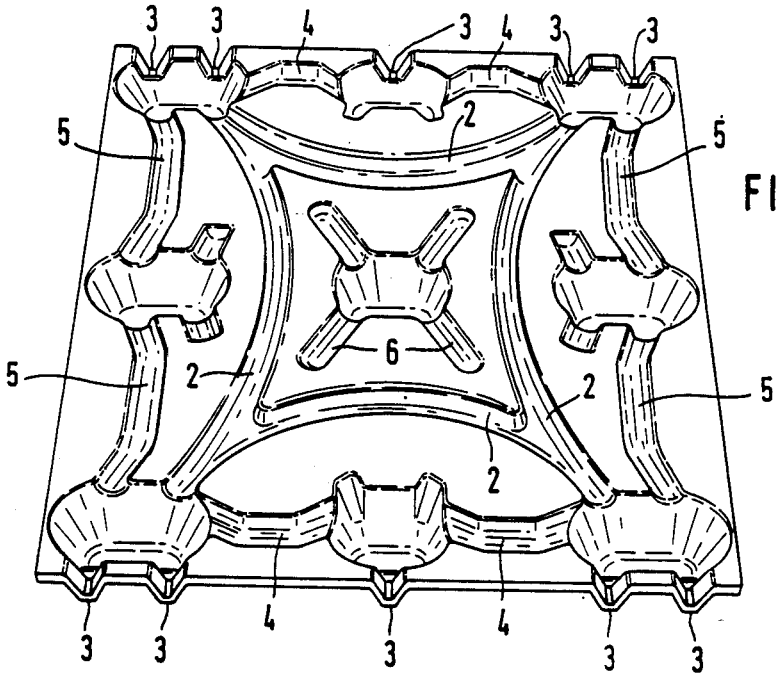
FIG. 3
FIG. 4
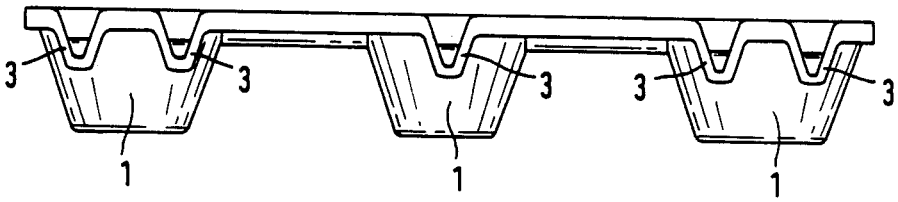
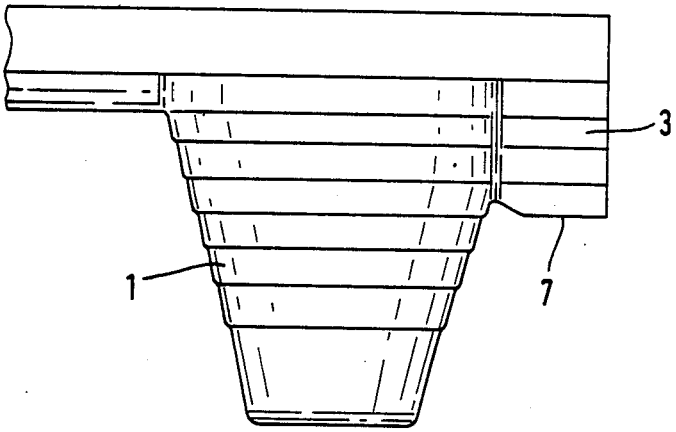
FIG. 5

ONE-PIECE PALLET WITH PLURALITY OF LEGS

BACKGROUND OF THE INVENTION

The present invention relates to a pallet. More particularly, it relates to a one-piece pallet which is pressed of a not rising mixture of fibers and a heat-hardenable binding agent with the use of pressure and heat.

Pallets of the above-mentioned general type are known in the art. A known pallet has a plurality of legs which are trough-shaped, open at their one side, and have a cross-section increasing toward their opening. The legs are connected by channel-like connecting webs. One of such pallets is disclosed, for example, in the DE-OS No. 2,731,131. The known pallets are designed so that they, together with the product placed on them, can be supported on flat surfaces, for example on a hall floor, a shelf, or on further stacked pallets loaded with the product, and can be transported on conveyor bands or by floor conveying devices.

However, it is required in increasing numbers to provide such pallets which, being loaded with its edges are transported in respective lift trucks in suspended position and which can be stored in the respectively designed suspending stands. The known pallets are not suitable for these purposes, since they do not have the required bending resistance for supporting a load which during the use of such pallets reaches up to four tons.

SUMMARY OF THE INVENTION

Accordingly, it is an object of the present invention to provide a pallet of the above-mentioned type, which avoids the disadvantages of the prior art.

More particularly, it is an object of the present invention to provide such a pallet which on its two edges can be transported in lying and loaded condition or can be supported.

In keeping with these objects and with others which will become apparent hereinafter, one feature of the present invention resides, briefly stated, in a pallet which has a plurality of legs arranged in its corners and connected by connecting webs, wherein the connecting webs have a course which is curved inwardly and does not contact other legs of the pallet.

When the pallet is designed in accordance with the present invention it attains the above-mentioned objects.

In accordance with another feature of the present invention, two opposite edges of the pallet are provided with several outwardly directed web ends.

Still a further feature of the present invention is that the web ends have a V-shaped construction and arranged in the region of the legs.

Another feature of the present invention is that the connecting webs which connect the legs located at the corners of the pallet with other legs are also curved.

These additional connecting webs can be bulged outwardly, in accordance with another feature of the present invention, in the vicinity of the edges connected with the web ends.

In contrast, the other of the additional connecting webs can be bulged inwardly in the vicinity of the edges which are not provided with the web ends.

Finally, a leg arranged in the center of the pallet can be provided with web ends extending diagonally toward the corners of the pallet.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a plan view of a pallet in accordance with the present invention as seen from below;

FIG. 2 is a perspective of the pallet shown in FIG. 1;

FIG. 3 is a plan view of the inventive pallet as seen from above, in perspective;

FIG. 4 is a side view of a pallet edge on which the pallet is supported both during transportation and during storage; and FIG. 5 is a front view of the edge in accordance with FIG. 4.

DESCRIPTION OF THE PREFERRED EMBODIMENTS

As can be seen from FIG. 1, a pallet in accordance with the present invention has nine legs identified with reference numeral 1. Four of these legs are arranged in the corners of the pallet. The remaining five legs are arranged in a cross-like manner symmetrically between the corner legs. The four corner legs of the pallet are connected with one another by curved connecting webs 2, which can be arcuate. Each pair of the connecting webs 2 first merge into one another in the vicinity of each corner leg and then merge into this leg. The connecting webs 2 contact only the corner legs at their ends, but do not contact other legs of the pallet.

In the pallet shown in FIG. 1 the right edge and the left edge are the edges on which the pallets are supported during transportation or during storage. These two edges are provided with web ends 3 which are directed outwardly. The design and arrangement of these web ends will be clear from the consideration of the following Figures. Moreover, in the vicinity of the edges of the pallet, further connecting webs are provided between the legs 1. These further connecting webs are identified with reference numerals 4 and 5.

The further connecting webs 4 are arranged at the edge which is provided with the web ends 3. The further connecting webs 4 are curved or bulged outwardly. The further connecting webs 5 are provided at two other edges of the pallet which do not have the web ends 3. These further connecting webs 5 are curved or bulged inwardly. Furthermore, the legs located in the center of the pallet are provided with diagonal web ends 6 which extend from the central leg toward the corners of the pallet.

The lower side of the pallet of FIG. 1 is shown in FIG. 2. It can be clearly seen that one edge of the pallet which is provided with the web ends 3 is located forwardly. Naturally, the other edge provided with the web ends 3 is located rearwardly in this Figure.

FIG. 3 shows the upper side of the pallet in a perspective, so as to more clearly illustrate the legs 1, the connecting webs 2 and the further connecting webs 4 and 5 in their interaction.

FIG. 4 clearly shows the construction of the web ends 3, whereas FIG. 5 shows a wide supporting face 7 which is formed by a web end 3 and serves for supporting of the suspended pallet in the stand.

The pallet in accordance with the present invention is a one-piece pallet which is formed as a compression molded part of a mixture of fibers and a heat-hardenable synthetic resin. The fibers can be ligno cellulose-containing fibers, comminuted and dried wood chips, bagasse fibers and the like. The heat-hardenable synthetic resin can be melamine resin, urea formaldehyde resin or phenolformaldehyde resin. Instead of the above-mentioned fibers, also fibers of other materials can be used solely or in mixture with one another, such as glass fibers, stone wool, or asbestos fibers. A binding agent, for example organic binding agent can be added to these fibers.

It will be understood that each of the elements described above, or two or more together, may also find a useful application in other types of constructions differing from the types described above.

While the invention has been illustrated and described as embodied in a pallet, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A one-piece pallet, comprising a body part having corners; a plurality of trough-shaped corner legs located in said corners of said body part; a plurality of further trough-shaped legs which are spaced from said corner legs; and a plurality of channel-like continuous connecting webs each merging into and connecting two of said corner legs with one another and curved inwardly continuously from one of said two corner legs to the other of said two corner legs so as not to contact any of said further legs.

2. A pallet as defined in claim 1, wherein each of said legs has two sides, an opening at one of said sides, and a cross-section which increases toward said opening.

3. A pallet as defined in claim 1, wherein said body part, said legs and said connecting webs together form a one-piece member which is pressed of a non-risable mixture of fibers and a heat-hardenable binding agent with the use of pressure and heat.

4. A pallet as defined in claim 1, wherein said body part has a plurality of edges including first two opposite edges located opposite to one another and second two opposite edges located opposite to one another; and further comprising a plurality of web ends arranged on said first two opposite edges.

5. A pallet as defined in claim 4, wherein said web ends are V-shaped and arranged in the region of said corner

6. A pallet as defined in claim 4, wherein said further legs include edge legs arranged on said edges of said body part; and further comprising a plurality of further connecting webs which are curved and connect said corner legs with said edge legs.

7. A pallet as defined in claim 6, wherein said further connecting webs include first further connecting webs, said first two opposite edges being provided with said web ends and are curved outwardly, said edges legs including first edge legs located near said first two opposite edges and near said web ends and connected with said corner legs by said first further connecting webs.

8. A pallet as defined in claim 6, wherein said further connecting webs include second further connecting webs which are located near said second two opposite edges not provided with said web ends and are curved inwardly, said edge legs including second edge legs located near said second two opposite edges and connected with said corner legs by said second further connecting webs.

9. A pallet as defined in claim 1, wherein said body part has a center and said further legs include a central leg which is located in said center of said body part.

10. A pallet as defined in claim 9; and further comprising a plurality of further web ends extending diagonally from said central leg toward said corner legs.

11. A pallet as defined in claim 1, wherein said connecting webs are curved arcuately.

12. A one-piece pallet comprising a body part having a plurality of corners and a plurality of edges extending between said corners and including a first two opposite edges located opposite to one another and second two opposite edges located opposite to one another; a plurality a trough-shaped corner legs located in said corners of said body part; a plurality of further trough-shaped legs which are spaced from said corner legs andinclude edge legs arranged on said edges of said pallet, said edge legs including first edge legs located near said first two opposite edges and second edge legs located near said second two opposite edges; a plurality of channel-like connecting webs which connect said corner legs with one another and are curved inwardly so as not to contact any of said further legs; a plurality of further connecting webs which are curved and connect said corner legs with said edge legs; and a plurality of web ends arranged on said first two opposite edges.

13. A one-piece pallet comprising a body part having a plurality of corners and a plurality of edges extending between said corners and including first two opposite edges located opposite to one another and second two opposite edges located opposite to one another; a plurality of trough-shaped corner legs located in said corners of said body part; a plurality of web ends arranged on said first two opposite edges; a plurality of further trough-shaped legs which are spaced from said corner legs and include edge legs arranged near said edges of said body part, said edge legs including first edge legs located near said first two opposite edges and near said web ends, and second edge legs located near said second two opposite edges; a plurality of channel-like connecting webs which connect said corner legs with one another and are curved inwardly so as not to contact any of said further legs; a plurality of further connecting webs which connect said corner legs with said edge legs, said further connecting webs including first further connecting webs which connect said first edge legs with said corner legs and are curnved outwardly, and second further connecting webs which connect said second edge legs with said corner legs and are curved inwardly.

* * * * *